US012138561B1

(12) United States Patent
Schott

(10) Patent No.: US 12,138,561 B1
(45) Date of Patent: Nov. 12, 2024

(54) MODULAR PANEL AND HINGE SYSTEM

(71) Applicant: Robert Schott, Cranford, NJ (US)

(72) Inventor: Robert Schott, Cranford, NJ (US)

( * ) Notice: Subject to any disclaimer, the term of this patent is extended or adjusted under 35 U.S.C. 154(b) by 240 days.

(21) Appl. No.: 17/824,840

(22) Filed: May 25, 2022

Related U.S. Application Data

(60) Provisional application No. 63/192,722, filed on May 25, 2021.

(51) Int. Cl.
*A63H 33/10* (2006.01)
*A63H 33/00* (2006.01)
*A63H 33/04* (2006.01)

(52) U.S. Cl.
CPC ..... *A63H 33/101* (2013.01); *A63H 33/008* (2013.01); *A63H 33/042* (2013.01); *A63H 33/044* (2013.01)

(58) Field of Classification Search
CPC ..... A63H 33/101; A63H 33/008; A63H 33/042; A63H 33/044
USPC ..... 446/104, 108, 109, 111, 112, 116, 120
See application file for complete search history.

(56) References Cited

U.S. PATENT DOCUMENTS

| | | | | |
|---|---|---|---|---|
| 3,827,177 | A * | 8/1974 | Wengel | A63H 33/101 446/124 |
| 4,785,565 | A * | 11/1988 | Kuffner | E04B 2/7427 40/605 |
| 6,009,930 | A * | 1/2000 | Jantschek | E04B 2/7431 160/352 |
| 6,565,406 | B2 * | 5/2003 | Huang | A63H 33/042 446/104 |
| 6,966,435 | B2 * | 11/2005 | Weiser | B65G 17/08 198/852 |
| 7,213,632 | B1 * | 5/2007 | Goldstein | E04B 2/7429 160/234 |
| 8,613,167 | B2 * | 12/2013 | Nobile | E04B 2/7427 52/745.05 |
| 9,874,010 | B2 | 1/2018 | Gosling | |
| 10,086,304 | B1 * | 10/2018 | LaChance, III | A63H 33/044 |
| 10,596,480 | B1 | 3/2020 | Samo et al. | |
| 10,612,721 | B2 | 4/2020 | Katz | |
| D912,163 | S | 3/2021 | Wilde | |
| 11,433,317 | B1 * | 9/2022 | Cairns | A63H 33/04 |
| 2004/0216271 | A1 | 11/2004 | Schott | |
| 2007/0264901 | A1 | 11/2007 | Sisamos | |
| 2018/0214786 | A1 * | 8/2018 | Crouse | A63H 33/105 |
| 2020/0353376 | A1 * | 11/2020 | Pratt | A63H 33/044 |

* cited by examiner

*Primary Examiner* — Nini F Legesse
(74) *Attorney, Agent, or Firm* — Lambert Shortell & Connaughton; David J. Connaughton, Jr.; Justin P. Tinger

(57) ABSTRACT

A modular hinge and clip system that enhances a child's play and creates the ability to construct and build from the child's imagination.

11 Claims, 12 Drawing Sheets

10

MODULAR PANEL AND HINGE SYSTEM

CROSS-REFERENCED TO RELATED APPLICATIONS

This application claims the benefit of U.S. Provisional Patent Application No. 63/192,722 filed on May 25, 2021, which is herein incorporated by reference in its entirety.

FIELD OF THE INVENTION

The present invention relates to a modular panel, hinge and clip system for use during a child's play.

BACKGROUND OF THE INVENTION

Children have vivid imaginations and when playing can create and imagine different objects. This system is designed to enhance the child's play and imagination with the ability to create and build many structures and spaces using a modular panel and hinge system.

SUMMARY OF THE INVENTION

This invention embodies a modular building and hinge system that comprises a plurality of panels, each having along each perimeter edge a plurality of semicircular protrusions extending from a front side and a back side of the plurality of panels. A plurality of clips, having a first open end and a second open end are configured to removably attach to the perimeter edge about the semicircular protrusions of the panels as well as to rods that enable the formation of a hinge.

The modular panel and hinge system can also include one or more ramp features extending from a planar surface of one of the plurality of semi-circular protrusions.

The hinge created by the clip, rod and panels can be positioned at various angles with respect to another panel connected to the same rod. The clips of the system further provide the ability to connect multiple panels together in a linear extension manner or through a hinge-like manner.

The surface of each of the panels can be accessorized and some can include apertures or windows formed therein.

Multiple panels can be combined using the clips and rods to form a larger play space or structure.

The rods can be configured to attach to different types and styles of building bricks or blocks.

In another embodiment, a modular panel for use with a modular panel and hinge system comprises a panel having at least two perimeter edges having a plurality of semi-circular protrusion positioned about a portion of each of the at least two perimeter edges, wherein the semi-circular protrusions extend from both a front and back side of the panel and a ramp feature formed along a planar surface and orthogonal to at least one of the semi-circular protrusions, wherein the ramp feature is configured to enable a clip to be slid up and onto the semi-circular protrusion.

BRIEF DESCRIPTIONS OF THE DRAWINGS

The foregoing and other objects, features, and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

FIGS. 1A-B illustrates a modular panel having multiple configuration points to attach additional panels.

Figure 5A:
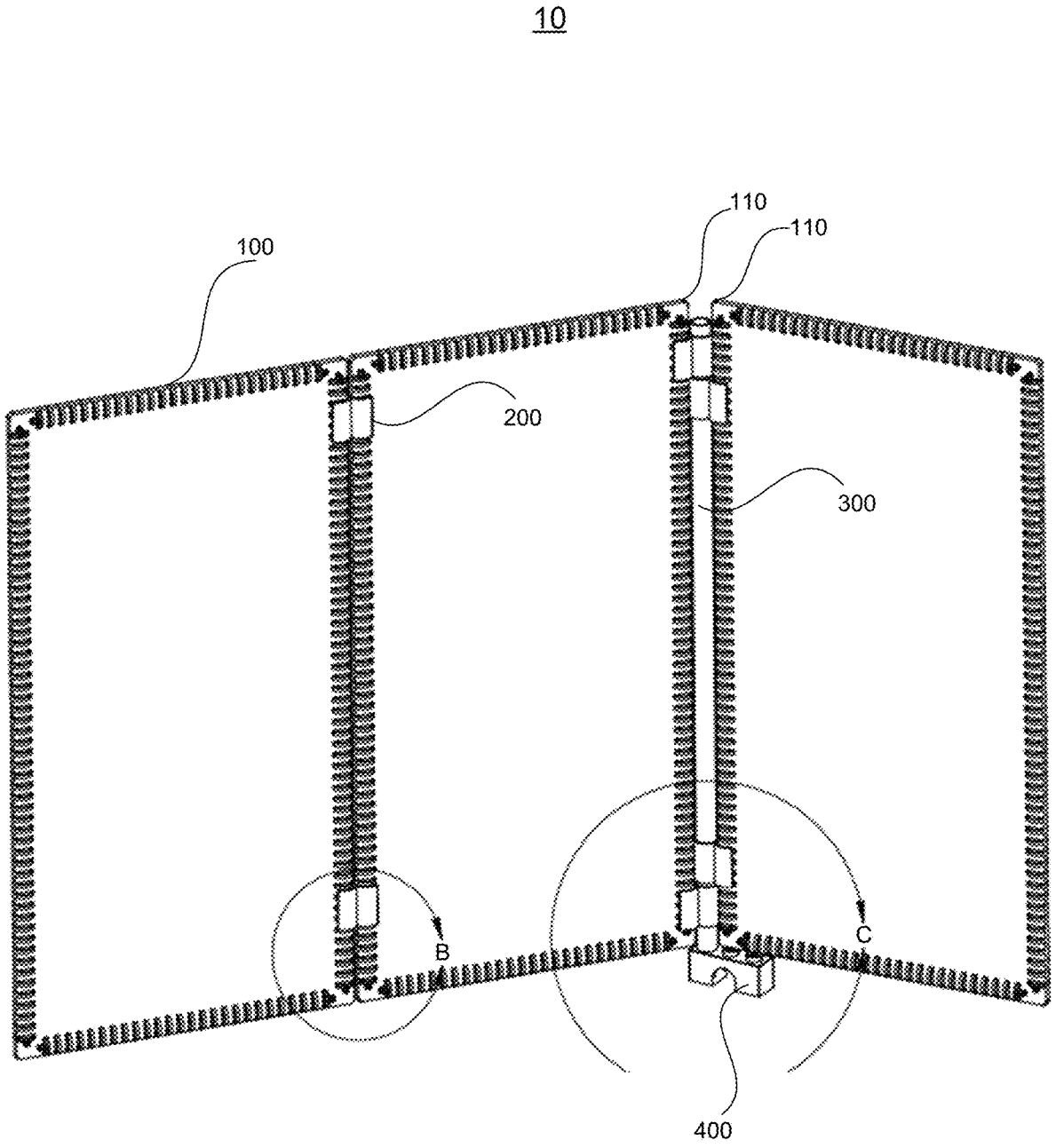
FIG. 5A illustrates multiple panels being combined together via a clip only configuration and a clip and rod configuration.
Figure 5B:
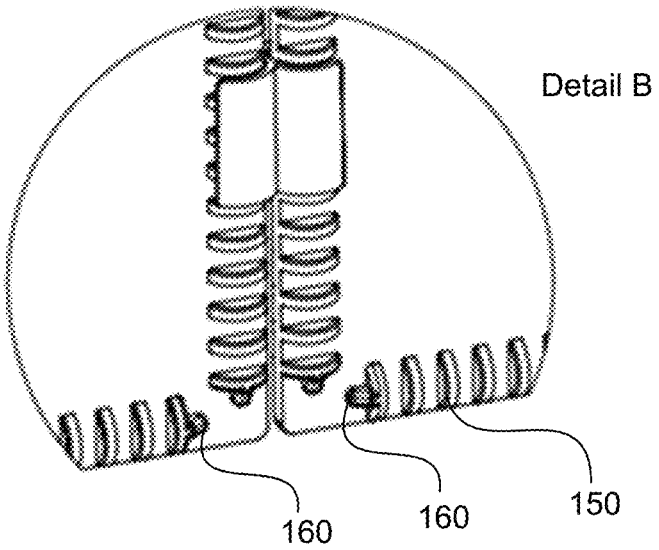
Figure 5C:
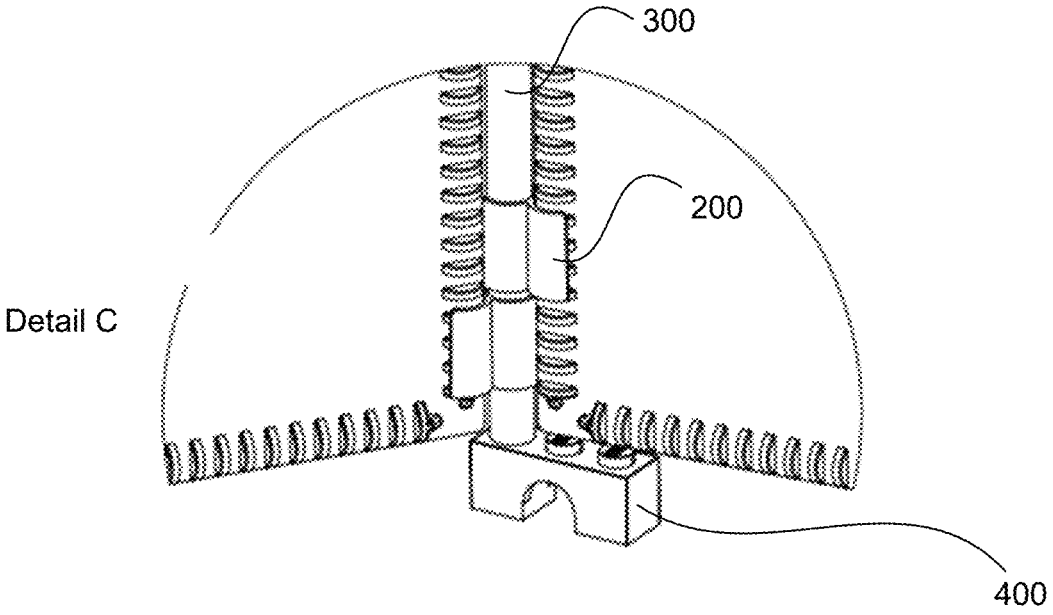

FIGS. 5B-C illustrate enlarged sectional views of FIG. 5A showing the different clip configurations, with and without a rod.

Figure 6:
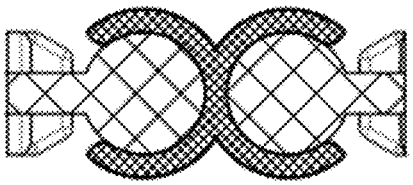

FIG. 6 illustrates a cross-sectional view of FIG. 5B.

Figure 7:
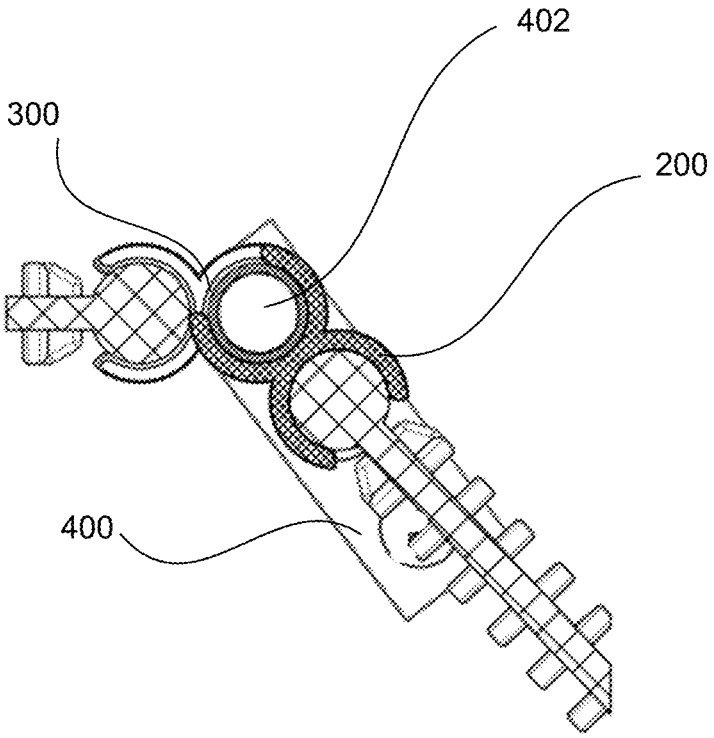

FIG. 7 illustrates a cross-sectional view of FIG. 5C.

Figure 8A:
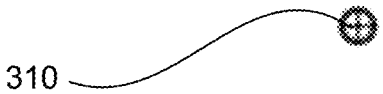
Figure 8B:
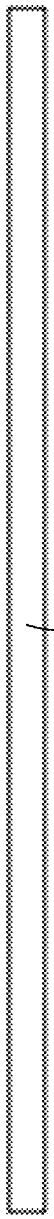

FIGS. 8A-B illustrates the rod used in the play system, and that the end of the rod can accept the node or protrusion of a toy brick.

FIGS. 9A-H illustrate and show different views of the various clip embodiments to be used with the modular panel and hinge system.

Figure 10:
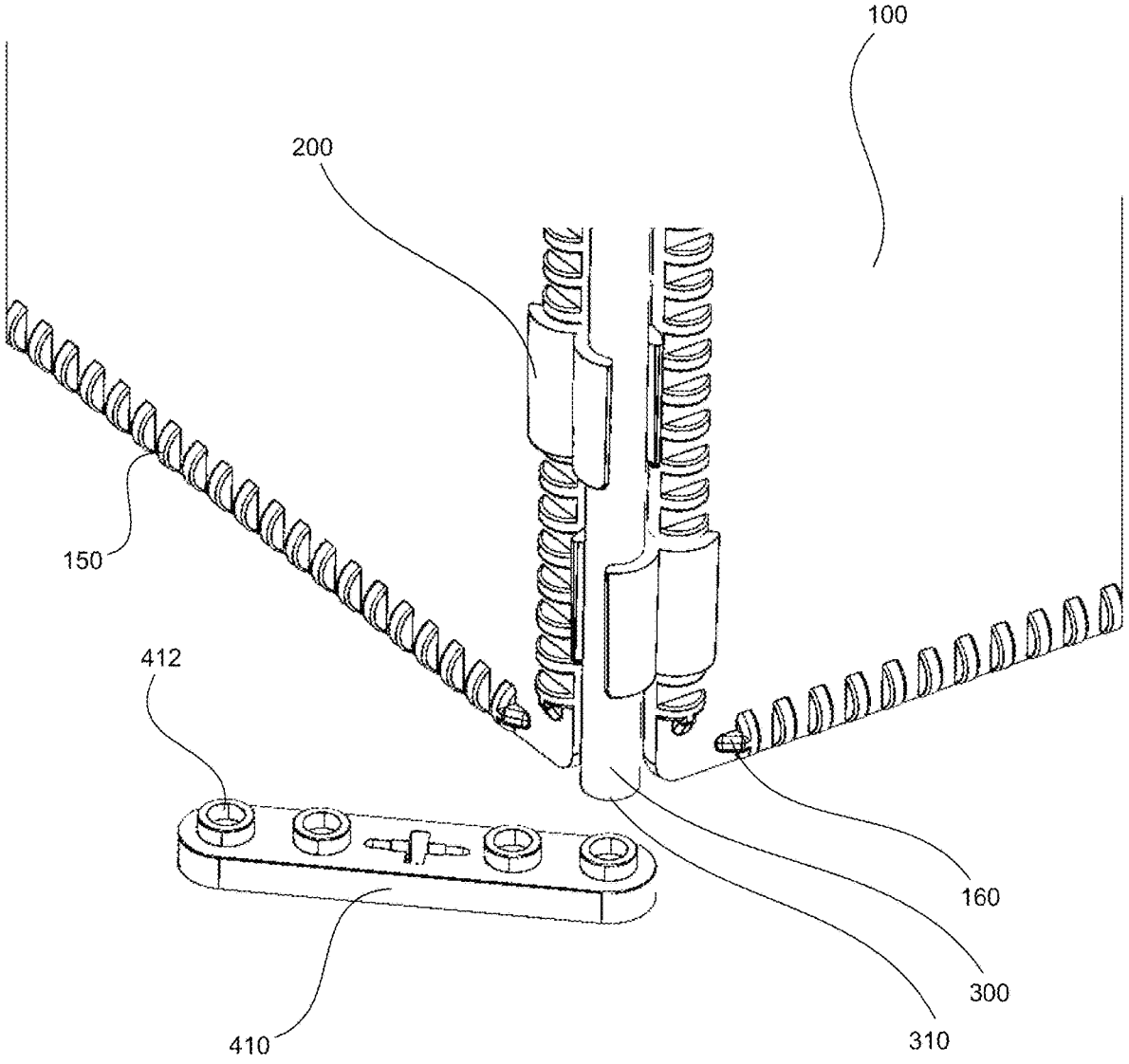

FIG. 10 illustrates an enlarged view of various components of and for use with a modular panel and hinge system.

Reference will now be made to the exemplary embodiments illustrated, and specific language will be used herein to describe the same. It will nevertheless be understood that no limitation of the scope of the invention is thereby intended.

DETAILED DESCRIPTION OF THE INVENTION

As discussed briefly above, the present invention seeks to provide a modular panel and hinge system for use with child's play. Child's play involving make-believe using various physical objects in a role-playing manner is a very integral part of the developmental stage of children, which has been scientifically determined by various studies. The modular panel and hinge system allows child's play to happen naturally and aide in this positive developmental stage, as the children are able to create various structures and spaces that coincide with their role playing and creative play. As such, the present invention seeks to provide improvements in the connection of materials in a modular panel and hinge system that allows for a child a way to construct and build various structures and spaces, thus stimulating the developmental cycle of child's play.

As viewed in FIG. 5A, the modular panel and hinge system 10 includes a plurality of panels 100 being attached with clips 200 and rods 300 to create a structure for use with child's play. The panels 100 are designed so that any edge of the panel can have a clip 200 attached to it. The edges of the panel include a plurality of semi-circle protrusions 150 with a gap disposed between each one. The corners of each panel are designed with a child in mind, and as such have rounded corners 110, so that there are no sharp corners for a child to injure themselves. Also, near the rounded corners 110, there includes a ramp feature 160 that allows the child to slide on clip 200 over and along the protrusions 150 formed along each edge of the panel. Thus, being able to move the clip along the length of the panel until the desired position is determined by the child or user. It should be noted that the clips can be designed to flex and be press-fit over the protrusions 150, but this might be more difficult for some children, thus the desire to have an easier method of connecting using the ramp feature 160 has been integrated herein.

Figure 4A:
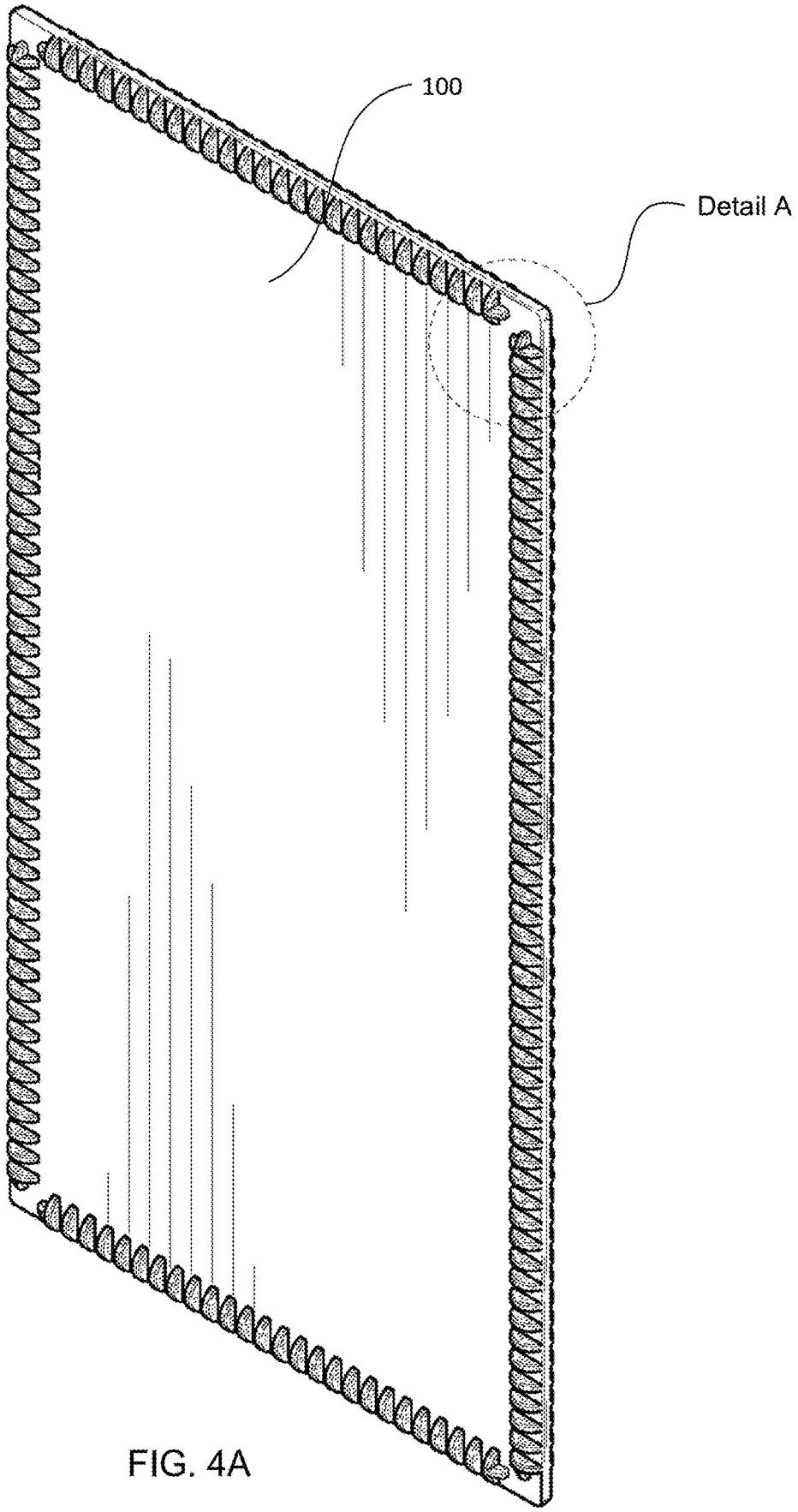
FIG. 4A illustrates a perspective view of a modular panel having multiple configuration points to attach additional panels.
Figure 4B:
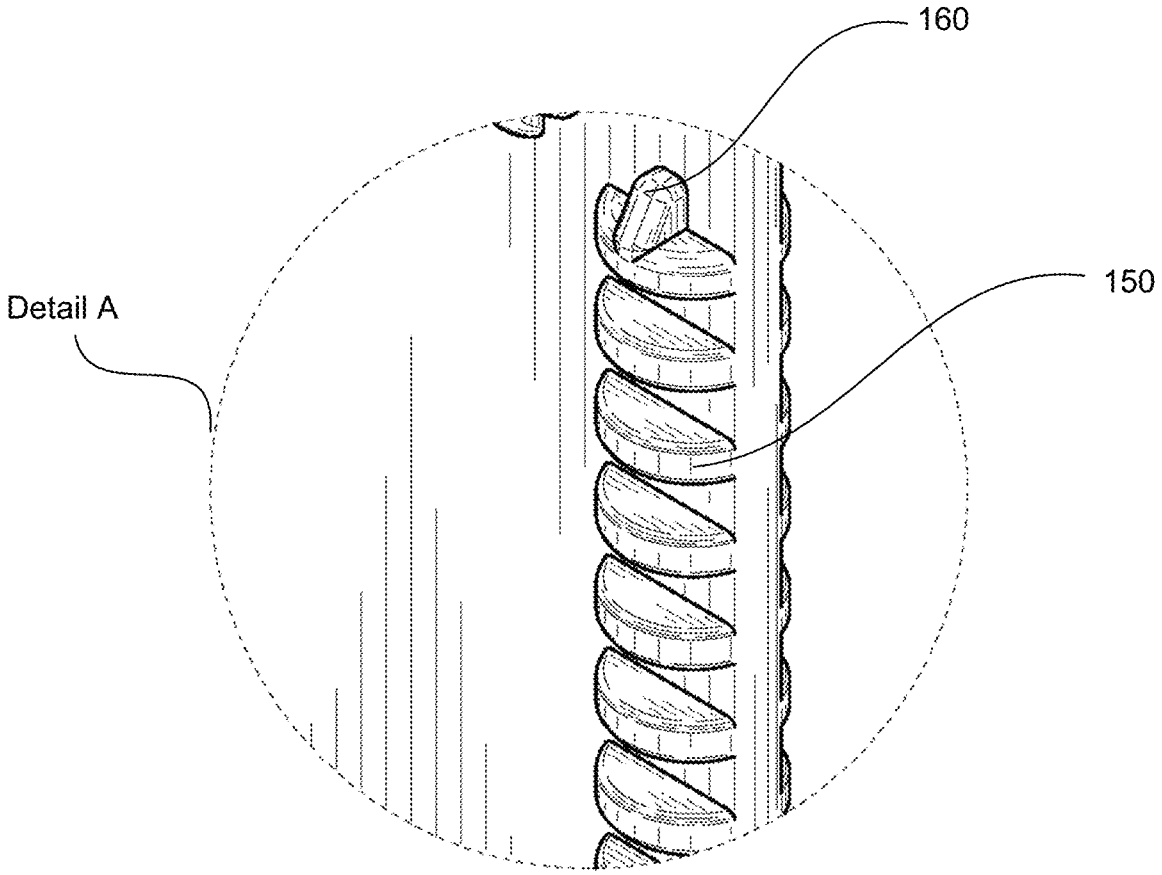
FIG. 4B illustrates a close-up view of the protrusions and ramp features of the panel.

As noted, the ramp feature 160, as shown in FIGS. 4A-B and 5B, is a ramp or sloped protrusion that allows the clip 200 to be easily maneuvered into place. The ramp feature 160 can be found on the edge or corner of each panel 100, and can be located on both sides (front and back) of panel 100.

A rod 300 is used with clips 200 and panels 100 to create hinge points, such as shown in the enlarged view of FIG. 5C as well as FIG. 10. The creation of the hinge points allows various structures and spaces to be created during child's play. For example, the rod, clips, and panels could be used to make a corner between panels or an angled roof. They could also be used to make doors. Rectangular, triangular, and various polygonal shapes and structures can be formed. Multiple clips 200 may be placed on the edge of the panel 100 in a manner that allows multiple panels to be attached to each other via clips 200. FIG. 5A and 10 illustrate where more than one panel 100 can be connected to the same rod 300 via clips 200 and though not illustrated explicitly the number of panels connecting to the same rod is only limited by space and length of the rod and clips. Thus, a single rod could have two, three, four or more panels connected thereto, which provides for additional creativity and structures to be generated.

FIGS. 1A-4A illustrate different views of panel embodiments 100, 100A. These panels shown are rectangular, however, this should not be construed to be limiting the scope of this invention, as many panels can be created with varying sizes and dimensions to accommodate a child's play, which is considered within the scope of this invention. For example, these panels could be square shaped, triangular shaped, circular shaped and so forth. Each edge of each panel can include protrusions 150 for attaching or alternatively, only one edge or portion of an edge can include a plurality of attachment protrusions 150.

Figure 1A:
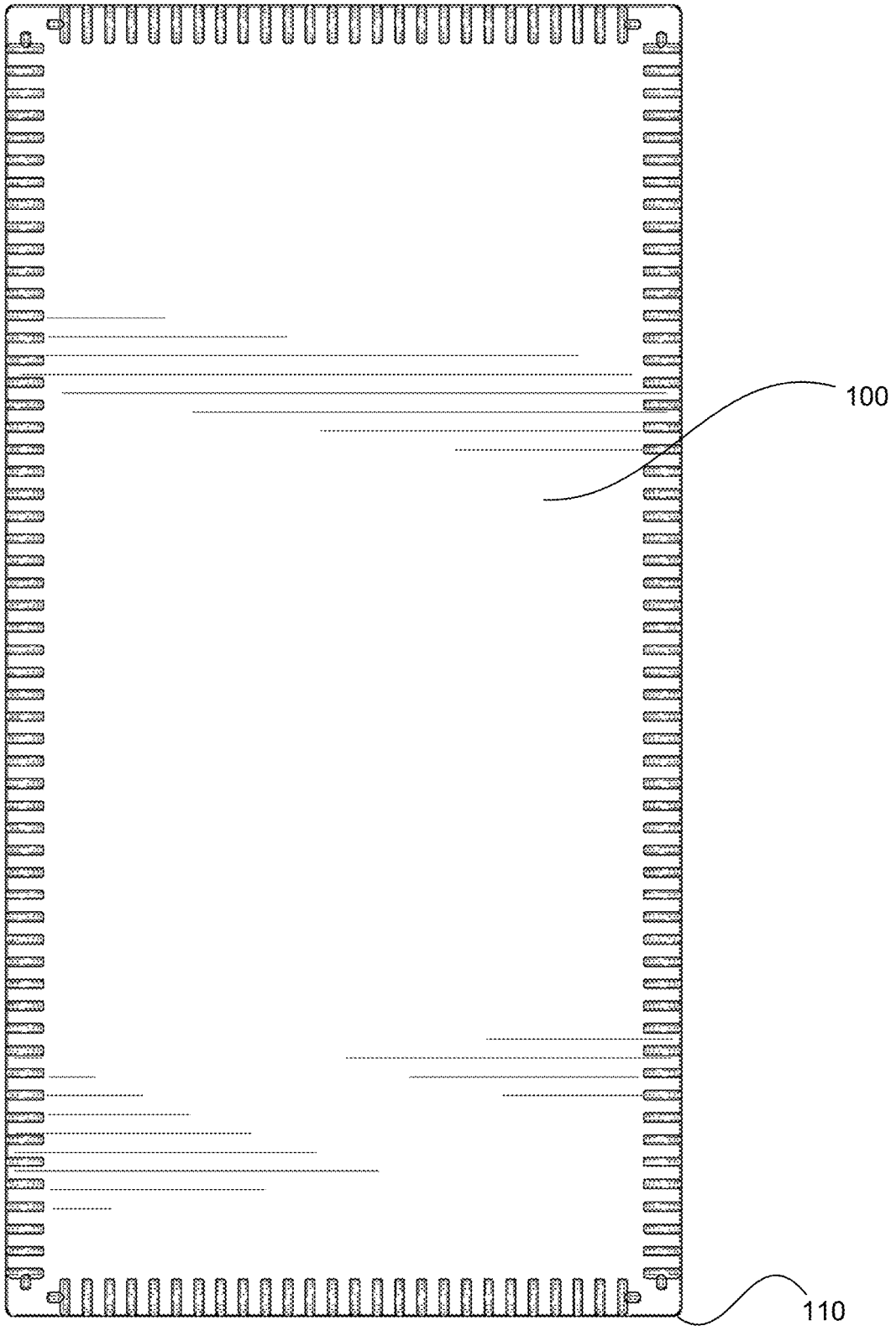
Figure 1B:
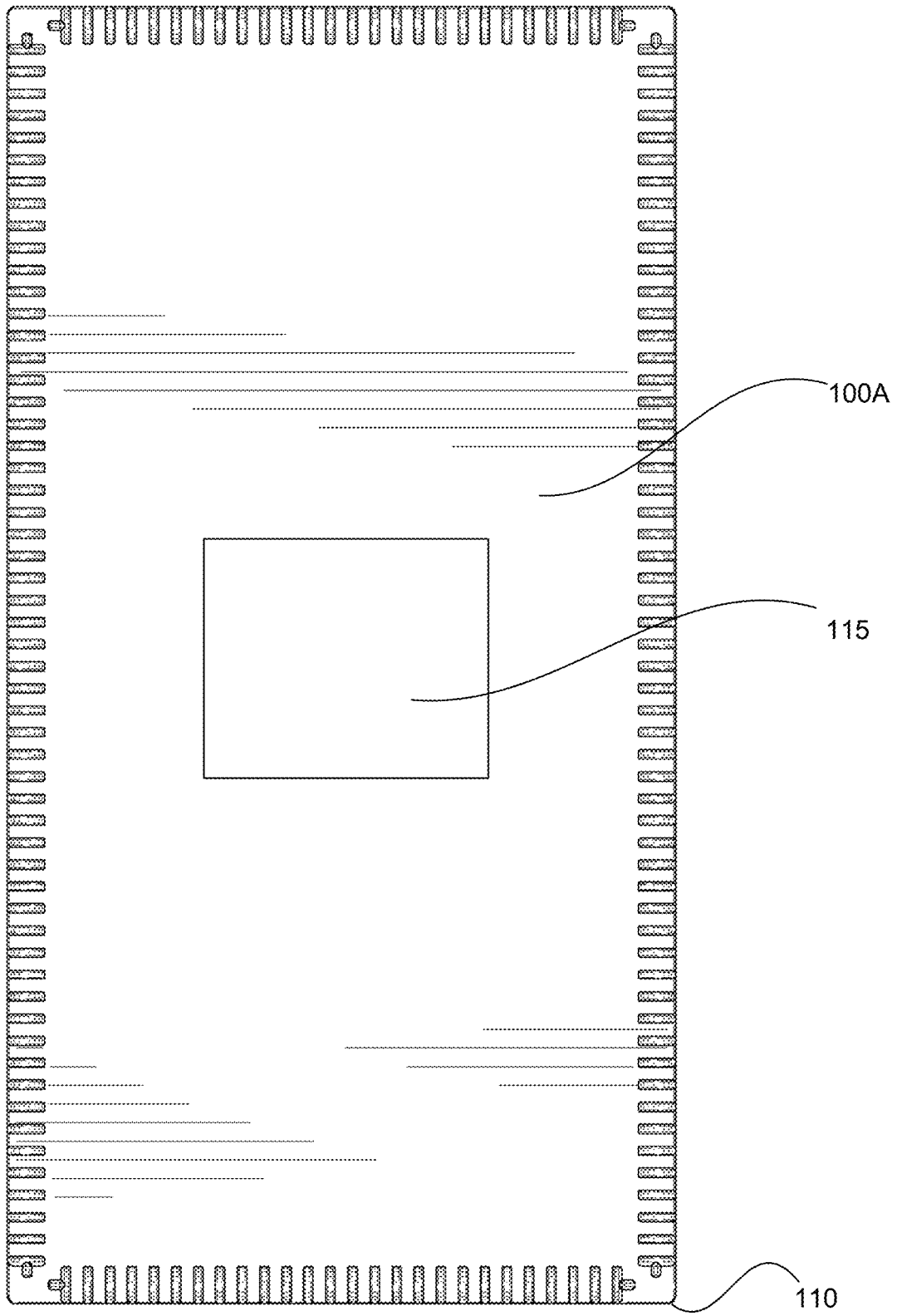
Figure 2:
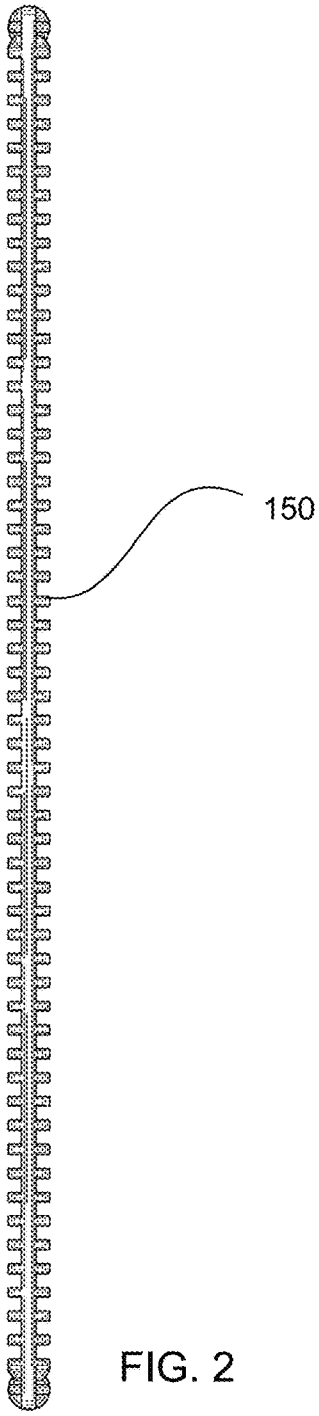
FIG. 2 illustrates a side view of a modular panel having multiple configuration points to attach additional panels.
Figure 3:
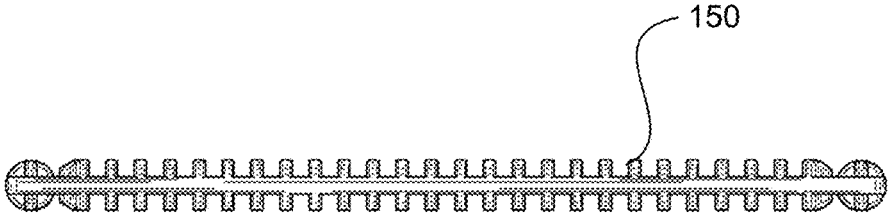
FIG. 3 illustrates a top-down view of a modular panel having multiple configuration points to attach additional panels.

FIG. 1B illustrates an alternative panel 100A that has an aperture 115 incorporated into it for different play options. Though only one aperture 115 is shown, the panels could be configured to have multiple apertures, which could imitate windows, doors, port holes, and other passageways.

It should be noted that these panels can also be used in a commercial setting and other settings and sized accordingly to need. Scaling the size of the panels to create office cubicles, as one example, is also considered within the scope of this invention.

Figure 9A:
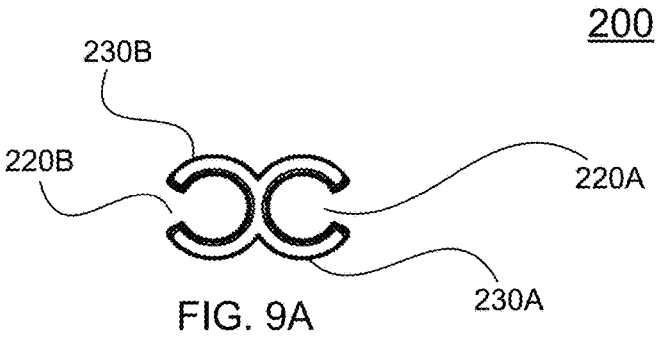
Figure 9B:
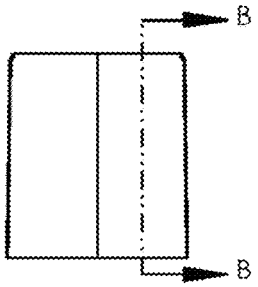
Figure 9C:
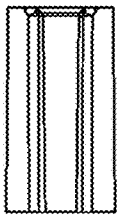
Figure 9D:
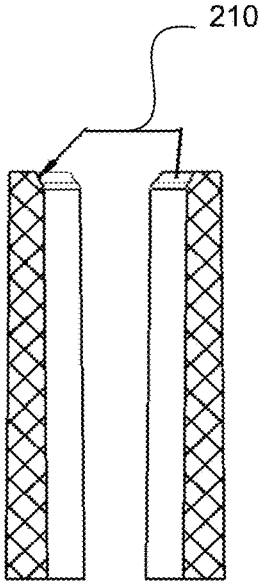
Figure 9E:
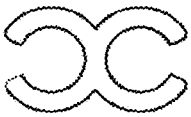
Figure 9F:
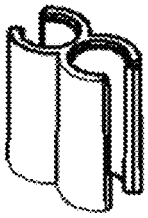
Figure 9G:
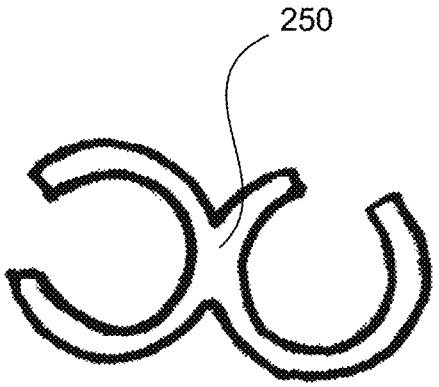
Figure 9H:
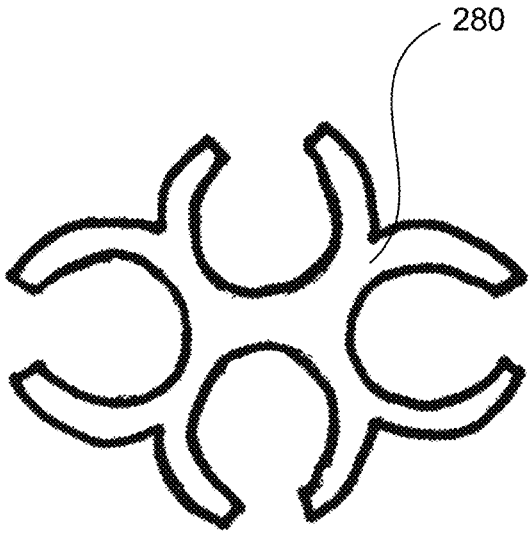

FIGS. 9A-H illustrate different views of the clip 200 as well as alternative clip embodiments 250 and 280. Specifically, as shown in FIG. 9F, one alternative clip embodiment includes 250, which has two clip portions similar to 200, except one of the clip openings is oriented at 90-degree with respect to the adjoining clip opening. Clip 280 includes a 4-way clip that could be attached to 4 panels or rods as opposed to two like 200 and 250. Each of these varying clips enables more methods of combining the panels and rods together.

Now referring to clip 200, which as noted above, is designed so that it can be slid over the ramp feature 160, and the semi-circle protrusions 150. Also as noted, clips 200 can also be snapped over the semi-circle protrusions 150 or rod 300 to facilitate and make it simple for a child to connect the panels 100 together easily and quickly.

Clip 200 includes an arm or clip portion 230A and 230B, where each includes an opening 220A and 220B as shown in FIG. 9A. The openings 220A and 220B are configured to receive the rod 300 or panel edges of 100, 100A. Clip 200 can include interior chamfer 210 about the outer edge of the arms 230A-B along the opening 220A-B portion, which allows the clip 200 to slide on to the semi-circle protrusions 150 or rod 300 easier. FIG. 9D shows a cross-section B-B of the clip, which helps illustrate this chamfer 210 formed about an inner edge of the arms 230A-B of the clip 200.

FIGS. 5A-C illustrate several views of one configuration of a modular panel and hinge system 10 as a simple demonstration of a rod 300, multiple panels 100 and clips 200 being joined together in a structure where two of the panels 100 are connected in an extended linear manner, and two of the panels form a hinged point. This example structure is meant to be exemplary and not limiting. One skilled in the art could readily use the components shown to create a variety of structures and spaces, which is the intended use.

Rod 300 is shown isolated with a top and side view in FIGS. 8A-B. Also shown in FIGS. 5A and 5C, as well as in FIG. 7 is the ability for the rod 300 to interface and connect with a toy brick 400. Toy bricks made from various plastics have existed for years, such as under the brand name LEGO. The modular hinge system 10 is configured to further interface with these toy bricks to again expand on the creative possibilities. The clips 200, 250 and 280 are configured to rotate about the rod 300 and vice versa, which enables a swinging action. This also enables panels to be angled with respect to each in various degrees.

FIGS. 6-7 are cross-sectional views of FIGS. 5A-B to illustrate the snug fit between the clips 200 and rods or panels. FIG. 7 specifically illustrates how rods 300 and specifically the hollow interior 310 can interface or be press-fit around the protruding portion 402 of toy brick 400.

FIG. 10 illustrates an enlarged view of various components of and for use with a modular panel and hinge system similar to that shown in FIG. 5A. The panels 100 are positioned at 90 degrees with respect to each other and connected via clips 200 to the same rod 300. An alternative toy brick component 410 having four protrusions 412, which can be connected to rod 300 via the aperture or hollow interior 310.

As can now be appreciated by reading the description and reviewing the drawings provided herein, there can be numerous different types of positions, configurations, and placements of the panels, clips, and rods to create various structures and spaces that can come with child's play, and these positions are not all inclusive or limiting to the structures and spaces that can be created. These include offsetting the height of panels with respect to each other, offsetting gaps or spaces in between panels, pivoting about various angles and forming slanted formations, joining multiple panels to one rod, and many other such variations.

FIGS. 5A, 5C, 7, 10 illustrate that the ends of each rod can be used to attach different pieces of toy bricks or panels with protrusions that are similar thereto. The opening on the end of the rod can be sized to fit about one of the protrusions of the building bricks. In short, the rod can be configured to interface with a plurality of other types of toys or third-party products.

The modular panel and hinge system is made of panels, clips, and rods, which can be fabricated out of numerous different types of materials, including various plastics, resins, metals, carbon-fiber, wood, including recycled materials and so forth. In a preferred embodiment, the material is such that it maintains a level of rigidity, while the clips have a certain amount of flexibility or elasticity about the arms 230, such that the arms can flex outward to expand opening 220A or 220B to received either rod 300 or the semi-circular protrusions 150. As noted above, the clips can also be slid onto rod 300 or over 150 using the ramp feature 160.

This system of panels, hinges, and clips has numerous commercial applications including use for offices, expos, pens, mazes, and so forth. The commercial versions might generally be sized larger and formed of materials that are appropriate for the given application, but the concepts taught and shown would remain the same.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Each of the panels described herein can further be accessorized. For example, the interior portions can have stickers, magnets, or items attached thereto or drawn on.

Furthermore, the described features, structures, or characteristics may be combined in any suitable manner in one or more embodiments. In the description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention.

The invention claimed is:

1. A modular system comprising:

a plurality of panels, each having along each perimeter edge a plurality of semi-circular protrusions extending from a first surface and a second surface of the plurality of panels;

a plurality of clips, wherein each clip has a first open end and a second open end; and at least one rod, wherein the rod is configured to attach to the plurality of clips, and wherein the clips are configured to be removably attached along the perimeter edges of each of the plurality of panels about the semi-circular protrusions.

2. The modular system of claim 1, further comprising a ramp feature extending from a planar surface of one of the plurality of semi-circular protrusions.

3. The modular system of claim 1, further comprising a clip that can be used with a rod to create a hinge, to create various angles between panels.

4. The modular system of claim 1, further comprising the ability to connect multiple panels together with multiple clips and rods, to create multiple angles between numerous panels.

5. The modular system of claim 1, wherein each of the panels includes at least one of the first and second surfaces configured to accessorize.

6. The modular system of claim 5, wherein the usable surface has one or more apertures disposed therein.

7. The modular system of claim 1, further comprising the ability to connect panels together by only using clips, thus creating a larger play space.

8. The modular system of claim 1, further comprising the ability to connect the end of each rod to different types and styles of building brick or blocks.

9. A modular panel for use with a modular panel and hinge system comprising:

a panel having at least two perimeter edges each having a plurality of semi-circular protrusions parallel to each other and positioned along a portion of the perimeter edge, wherein the semi-circular protrusions extend from both a first and a second surface of the panel; and a ramp placed at one end of the plurality of semi-circular protrusions, triangularly shaped, protruding from the panel, and orthogonal to the plurality of semi-circular protrusions, wherein the ramp is configured to enable a C-clip to be slid up and onto the plurality of semi-circular protrusions.

10. The modular panel for use with a modular panel and hinge system of claim 9, wherein the panel further includes an aperture formed an interior portion of the panel.

11. The modular panel for use with a modular panel and hinge system of claim 9, including the C-clip attached to the plurality of semi-circular protrusions.

* * * * *